US007448444B2

(12) United States Patent
Thomson et al.

(10) Patent No.: US 7,448,444 B2
(45) Date of Patent: Nov. 11, 2008

(54) TUBING SAVER ROTATOR AND METHOD FOR USING SAME

(76) Inventors: Michael A. Thomson, 1001 N. Market St., Suite 20, Mt. Carmel, Wabash County, IL (US) 62863; Philip E. Hart, 1001 N. Market St., Suite 20, Mt. Carmel, Wabash County, IL (US) 62863

( * ) Notice: Subject to any disclaimer, the term of this patent is extended or adjusted under 35 U.S.C. 154(b) by 238 days.

(21) Appl. No.: 11/143,027

(22) Filed: Jun. 2, 2005

(65) Prior Publication Data

US 2005/0230099 A1 Oct. 20, 2005

Related U.S. Application Data

(63) Continuation-in-part of application No. 10/356,750, filed on Feb. 3, 2003, now abandoned.

(60) Provisional application No. 60/371,393, filed on Apr. 10, 2002.

(51) Int. Cl.
*E21B 33/03* (2006.01)
*E21B 33/04* (2006.01)

(52) U.S. Cl. ..... 166/75.14; 166/78.1; 166/379; 166/382

(58) Field of Classification Search ..... 166/75.14, 166/78.1, 85.4, 77.51, 382, 379
See application file for complete search history.

(56) References Cited

U.S. PATENT DOCUMENTS 4,314,611 A * 2/1982 Willis ..... 173/197
5,308,229 A * 5/1994 DuPuis et al. ..... 417/368
5,465,788 A * 11/1995 Wright ..... 166/78.1

* cited by examiner

*Primary Examiner*—Shane Bomar
(74) *Attorney, Agent, or Firm*—Gary K. Price, Esq.

(57) ABSTRACT

A tubing rotator assembly that attaches to a casing head to suspend and rotate a tubing string in an oil well. The tubing assembly includes a rotation surface, such as a bearing, in which a tubing mandrel rests and allows one to rotate the tubing manually above the wellhead, and a mandrel bowl that rests inside the casing head. A tubing mandrel is partially contained within the mandrel bowl with one end exiting the bowl and attached to the tubing string, and the opposite end exiting the top of the bowl. A ledge of the tubing mandrel is supported on the bearing, which bearing rests on the interior ledge of the mandrel bowl. The assembly provides a low profile reducing the distance between the casing head and the pumping tee to eliminate the need to raise the pumping unit to fit on the rotator.

3 Claims, 11 Drawing Sheets

TUBING SAVER ROTATOR AND METHOD FOR USING SAME

CROSS REFERENCES TO RELATED APPLICATIONS

U.S. Provisional application for Patent 60/371,393, filed Apr. 10, 2002, with title "Tubing Saver Rotator and Method for Using Same" which is hereby incorporated by reference. Applicant claims priority pursuant to 35 U.S.C. Par. 119(e)(i). Application is also a continuation-in-part of application Ser. No. 10/356,750, filed Feb. 3, 2003, now abandoned.

Statement as to rights to inventions made under Federally sponsored research and development: Not Applicable

BACKGROUND OF THE INVENTION

1. Field of the Invention

This invention relates to a tubing rotator assembly that sits inside a casing head for purposes of suspending and rotating the tubing string in an oil well.

2. Brief Description of Prior Art

A typical wellhead is often comprised of a casing head which engages or is otherwise mounted to a casing string contained within a wellbore of a well at the surface. A mandrel bowl is mounted to the casing head and provides a support mechanism for the tubing string which is contained within the wellbore.

The production of fluids from an oil and gas well often involves the use of a downhole pump that can pump fluids to the surface through the tubing string. This downhole pump is often mechanically actuated through the use of a rod string located within the tubing string. The rod string is usually reciprocated up and down at the surface or, rotated at the surface to impart motion on the pump. The reciprocation or rotation of the rod string causes the rods to wear against the tubing, which may cause the tubing string to wear thin and develop a hole in the tubing. This wear action also wipes off chemical inhibitors that may be placed into a well to minimize corrosion of the tubing and rods by the production fluids. Thus, the wear action can also lead to tubing holes due to corrosion since the inhibitors are wiped off. These wear related holes in the tubing causes inefficient lift or no lift of the fluids to the surface and typically requires a rig to service the well. Reducing the failure frequency of the tubing strings will not only reduce operating costs but also will allow additional oil to be developed by reducing the economic production rate limit of each well.

Since 1927, several patents have been obtained on variations to tubing rotators that generally rotate the tubing manually or automatically to attempt to reduce the frequency of tubing holes developed due to the wearing action of the rods. Conventional casing heads are not typically able to be retrofitted to accommodate the necessary structure of a tubing rotator. Further, the tubing rotators of the prior art typically use gears and drive assembly to rotate the tubing. As a result, a housing is normally required to be attached above the casing head to provide room for the gearing and allow a rod to exit the tubing rotators of the prior art to allow manual rotation or automatic/continuous rotation of the tubing string.

These prior art designs therefore often include several seals to seal off the rod attached to the gears, seal the fluids between the casing and tubing, and further seal fluids produced up the tubing from exiting the tubing string into the atmosphere, ground, or annulus between the tubing and casing. The rotators with continuous rotation commonly have more corrosion holes due to wear than a manual or intermittent rotator, and fail when a gear mechanism fails and may damage the rotator or wellhead assembly due to the torque imparted on the gears. In addition, the positioning of a housing on top of the casing head is more costly and may involve the need to raise the pumping unit due to large spacing requirements between the casing head and the pump tee.

Wright U.S. Pat. No. 5,465,788 shows one prior art approach, a spline is used at 11 on the tubing hanger apparatus to allow one to attach a geared tubing rotator that will not fit within a Blow out protector "BOP" (thus, the reason for the spline design is to allow removal without turning the tubing). Wright's tubing hanger apparatus design and attached gear tubing rotator cannot all be removed or installed with the BOP stack attached to the wellhead. Further, the upper end of the tubing mandrel of Wright is disengaged from the tubing rotator through the application of force in a direction parallel to the longitudinal axis of the tubing string. This means a rig must be employed to pull the rotator assembly out of the tubing hanger to service the well. Further, Wright requires seals around the mandrel bowl and/or tubing mandrel to prevent communication between the high pressure fluids in the tubing and the low pressure fluids in the annular area surrounding the tubing. Failure of these seals leads to immediate pumping operation failure and loss of bearing lubrication and corrosion protection. Further, the rotator assembly attached to the tubing hanger has to be removed to change the conventional seals in Wright's design.

As will be seen from the subsequent description, the preferred embodiments of the present invention overcome these and other shortcomings of prior art.

There is need for a compact tubing rotator that may be operated manually or automatically to provide periodic and/or disproportionate rotation, reduces the height clearance between the casing head and the pump tee, is inexpensive, has minimal seals to potentially fail and leak fluids, provides for replacement of rubbers or seals that protect the atmosphere and environment from leaking fluids without removing the pump tee, the tubing rotator or tubing string from the well, provides additional seals to minimize or stop contamination of the grease packed bearing housing from wellbore or external fluids, utilizes commonly available equipment to reduce costs of repairs, and provides ease of installation and use.

The present invention is an apparatus for attachment within an existing casing head or within a casing head modified to accept a bowl or ledge assembly. In the preferred embodiment, this apparatus has a bearing in which a tubing mandrel rests and allows one to rotate the tubing manually above the wellhead. It provides a low profile reducing the distance between the casing head and the pumping tee, which may eliminate the need for one to raise the pumping unit to fit on the rotator. In addition, the conventional seals located above the bowl assembly have less chance of leaking fluids located between the casing and tubing as a result of the seals installed in the present invention. In addition, if the conventional rubber seal element starts to leak, then one can change the sealing elements without having to remove the pump tee, rotator assembly or tubing string from the well. In addition, some of the seals in the preferred embodiment can be changed without having to remove the pump tee, rotator assembly or tubing string from the well.

SUMMARY OF THE INVENTION

This invention relates to a tubing rotator assembly that sits in a casing head for purposes of suspending and rotating the tubing string in an oil well. The assembly includes a mandrel bowl or mandrel support that rests in the casing head. The mandrel bowl has an interior ledge with a surface on which a bearing may be placed. A tubing mandrel is partially contained within the interior of the mandrel bowl with one end exiting the bottom of the mandrel bowl and attached to the tubing string in the well, and the opposite end of the tubing mandrel exiting the top of the mandrel bowl. The tubing mandrel has a ledge which is rotatably mounted to the mandrel bowl. The ledge of the tubing mandrel is supported on the bearing, which bearing rests on the interior ledge of the mandrel bowl. The ledge of the tubing mandrel therefore engages and rotatably rides against the bearing. This arrangement allows the tubing to rotate by rotating the mandrel residing on the bearing disposed on the interior ledge of the mandrel bowl. The top of the tubing mandrel may be connected to a swivel, or be an integral part of the swivel, or connected to a union, or connected directly to a pump tee with the ability to partially or fully rotate in such a manner to allow one to rotate the tubing by turning the mandrel and or rotating part of the swivel. Normally, one would use a handle or pipe wrench to manually turn the mandrel or swivel or union that extends above the wellhead or, a device known in the art may be applied to automatically turn the mandrel or swivel or union. This design allows one to turn the tubing to the right and/or the left in a uniform manner or in a disproportionate manner that skips part of the rotation to benefit the pull strength of the tubing when removed after operation.

Seals are provided (but not necessary due to the conventional rubber seal above the bowl) to isolate the interior of the mandrel bowl from fluids from the well or outside the well before, during or after installation, thereby preserving any lubrication of the bearings and minimizing corrosion or contamination inside the mandrel bowl area. If these seals leak or are not provided, then the pump will continue to work since they are used to protect the bearings and not to seal the tubing fluids from the annular fluids. Seals may also be placed on the outside of the mandrel bowl or bowl plate, or inside the casing head, in order to provide additional sealing of the fluids between the casing and tubing strings. A bowl plate is positioned on top of the mandrel bowl with seals preferred to allow sealing between the bowl plate and the mandrel bowl and also between the bowl plate and the tubing mandrel. This allows the tubing rotator assembly to be a self contained unit with connection ends above and below the mandrel bowl to allow connection to the tubing string below the mandrel bowl and connection to a swivel, union, or other material to allow fluids to exit the wellbore from the tubing.

DESCRIPTION OF THE PREFERRED EMBODIMENT

FIGS. 1-4 illustrate a preferred embodiment of a tubing saver rotator assembly 100 made in accordance with the present invention. Generally, the present invention is an apparatus for attachment in an existing casing head or a casing head modified to accept a bowl or ledge assembly. This apparatus having a surface, such as a bearing in which a tubing mandrel rests and allows one to rotate the tubing above the wellhead. It provides a low profile reducing the distance between the casing head and the pumping tee, which may eliminate the need for one to raise the pumping unit to fit on the rotator. In addition, the conventional seals above the bowl assembly have less chance of leaking fluids located between the casing and tubing due to the seals potentially installed in the present invention. In addition, if the conventional seals do start to leak, one can change the sealing elements without having to remove the pump tee, tubing rotator assembly 100 or tubing string (not shown) from the well. In addition, some seals in the preferred element can also be changed without removal of the pump tee, tubing rotator assembly 100 or tubing string (not shown) from the well.

In the preferred embodiment, the present invention includes a pin end projecting upwardly from the mandrel or from the swivel joint. This allows a rig to pick up the mandrel and attach it to the pump tee above the wellhead and to the tubing string below the mandrel by simply screwing on two connections as will be further described. A conventional screwdriver or hex wrench will allow replacement of all the seals in the bowl and tubing mandrel assembly if replacement becomes necessary. If the fluids between the casing head and tubing string start to leak around the wellhead, sealing elements may be tightened to effect a good seal, or the seal elements may be replaced and tightened without removing the pump tee, tubing rotator or tubing string with a rig. This provides ease and speed of repair by one person in lieu of a conventional rig job, which may help the environment and lower operating costs.

Figure 1:
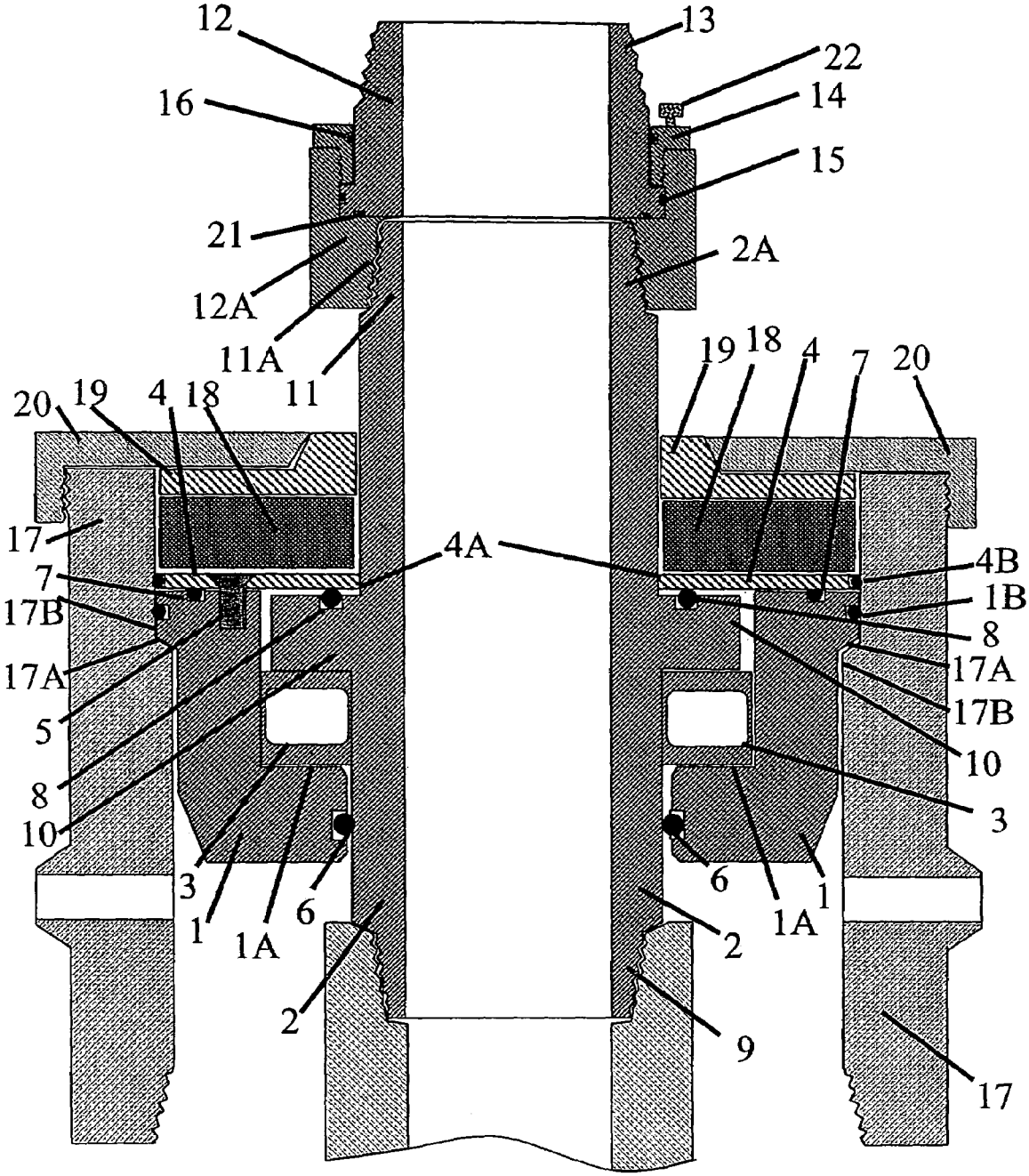
FIG. 1 is a front view of a preferred embodiment of the present invention, a tubing saver rotator within a conventional wellhead.

Referring to FIG. 1, the tubing saver rotator assembly 100 includes a mandrel bowl 1 having a ledge support 1A, said mandrel bowl 1 positioned on an interior lip 17A within a casing head 17. A tubing mandrel 2 having an extending mandrel ledge 10 is rotatably mounted to the mandrel bowl 1. In the preferred embodiment, said mandrel ledge 10 of the tubing mandrel 2 is substantially perpendicular to the length of the tubing mandrel 2 however, it is understood that the mandrel ledge 10 may be disposed at other angles in relationship to the tubing mandrel 2 and achieve the objectives described herein.

The mandrel ledge 10 may be supported on the surface of the ledge support 1A of the mandrel bowl 1 or, as shown in the drawings, may be supported on a bearing 3, which bearing 3 rests on the ledge support 1A of the mandrel bowl 1. The mandrel ledge 10 and the ledge support 1A therefore captures the bearing 3 therebetween. The mandrel ledge 10 of the tubing mandrel 2 therefore engages and rotatably rides against the bearing 3.

A bowl plate 4 is attached to the mandrel bowl 1 with bowl plate screws 5 selectively located around the bowl plate 4. A lower interior bowl seal 6, a bowl plate seal 7, and a mandrel plate seal 8 prevents fluid from contaminating the bearing 3.

The lower end of the tubing mandrel 2 is attached to the tubing string (not shown) with a lower connection 9, and the opposite end of the tubing mandrel 2 is attached to a swivel 12 with an upper connection 11. As shown in FIG. 1, the swivel 12 is attached to an upper end 2A of the tubing mandrel 2, which allows a lower part 12A of the swivel 12 to rotate with the tubing mandrel 2. An upper part 13 of the swivel 12 may be attached to a stationary pump tee (not shown). A swivel cap 14 connects the lower part 12A of the swivel 12 to the upper part 13 of the swivel 12, and seals 15, 16, and 21 are provided in the swivel 12 to prevent leakage or entry of fluids from the tubing mandrel 2 or environment. A union (not shown) could be used in lieu of the swivel 12 as well as substitution of other types of mechanisms known in the art to allow rotation or, the tubing mandrel 2 may be attached directly to the pump tee with the pump tee designed to allow some movement or rotation. The movement of the pump tee can be accomplished by using a flexible hose (not shown) as a means to connect the pump tee to a stationary flowline.

A rubber or packing element 18 is disposed on top of the bowl plate 4. A top plate 19 is then disposed on top of the rubber or packing element 18, the top plate 19 is compressed down to squeeze the rubber element 18 between the top plate 19 and the bowl plate 4 by a casing head dognut 20. The dognut 20 may be removed to grease the bearing 3 area if desired or to replace the top plate 19, rubber element 18, bowl plate 4, bowl plate screws 5, bowl plate seal 7, or mandrel plate seal 8. This arrangement allows most seals to be easily replaced by one person without removing the swivel 12, pump tee (not shown), tubing mandrel 2 and mandrel bowl 1 which would normally require a rig in prior art designs. The dognut 20 may be tightened down from time to time if any wellbore fluids start to leak out of the casing head 17 or it may be tightened after replacing the rubber element 18. The seals 6, 7, and 8 reduce the chance that the rubber element 18 will leak and thereby provides extra sealing protection.

Figure 2:
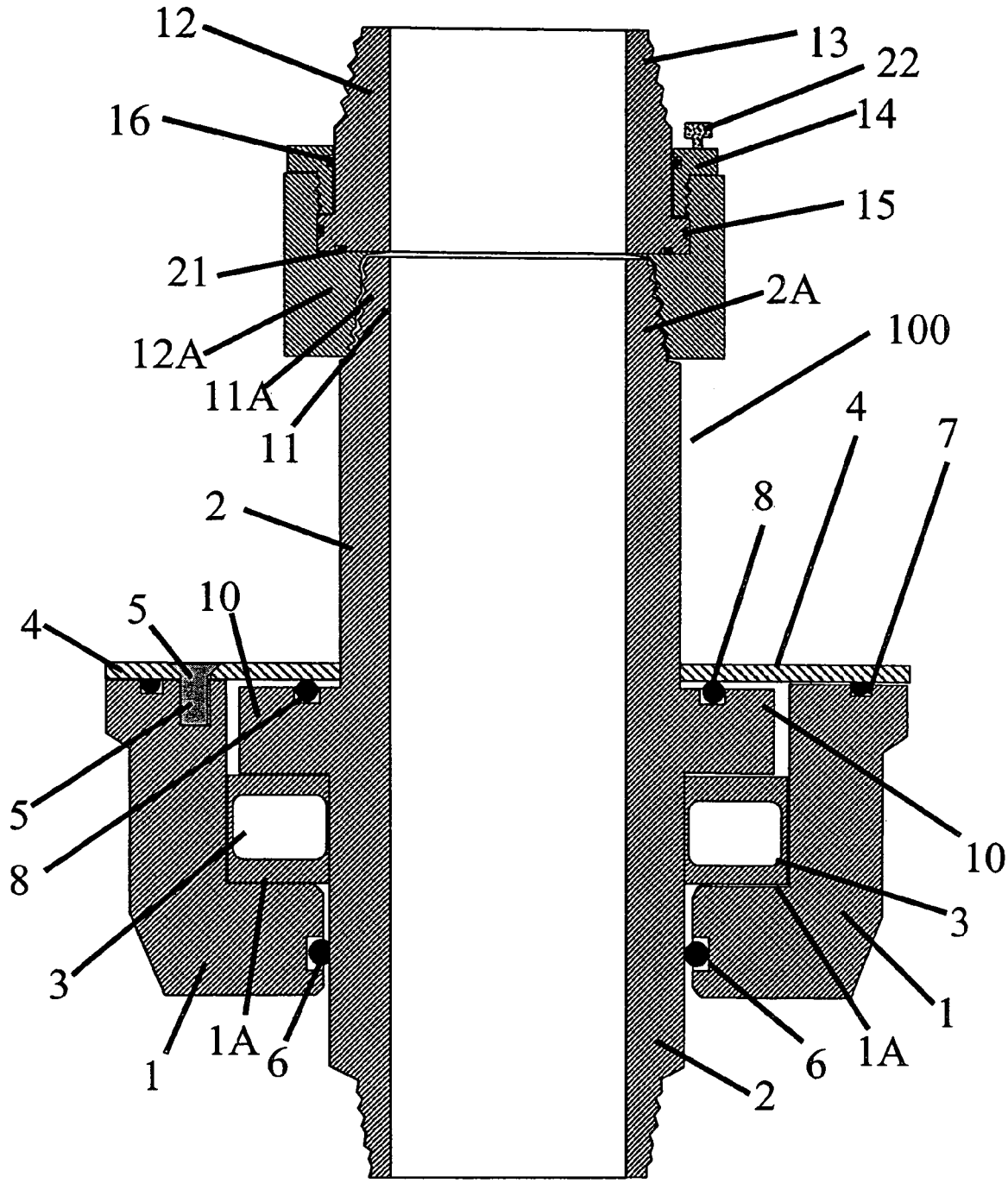
FIGS. 2-4 are front views of the tubing rotator saver of FIG. 1 without the standard equipment generally found on wellheads.

FIG. 2 illustrates the rotator assembly 100 shown in FIG. 1 without the standard equipment normally on certain wellheads. Thus a rig only needs to pick up the entire pre-assembled rotator assembly 100 and stab the bottom pin into the tubing string, lower the mandrel bowl 1 into the well with the rig, and then attach the swivel and/or pump tee (depending on if the rig desired to install the swivel separately or as one piece). The bowl 1 may then be packed off in the wellhead with the plates and rubber element that are standard equipment for that wellhead.

Various options may be chosen to enhance or reduce the cost of the rotator assembly 100. For example, the seals 6, 7, and 8 may be eliminated, however fluids may enter the bearing 3 area during installation or operation of the oil and gas well. Seals or packing could also be used between the mandrel bowl 1 and casing head 17 to provide extra backup seals or eliminate the need for the bowl plate seal 7. If care is taken during installation, the mandrel plate seal 8 may be eliminated if the rubber element 18 is providing a good seal. In addition, the mandrel plate seal 8 may be replaced with a seal between the outer diameter of the mandrel ledge 10 and the mandrel bowl 1, a seal between the tubing mandrel 2 and the inner diameter of the bowl plate 4, and/or a seal between the top plate 19 and the tubing mandrel 2. In addition, seals may be used between the bowl plate 4 and the casing head 17, or between the top plate 19 and the casing head 17, in order to provide additional backup seals, or to eliminate the rubber element 18.

Figure 5:
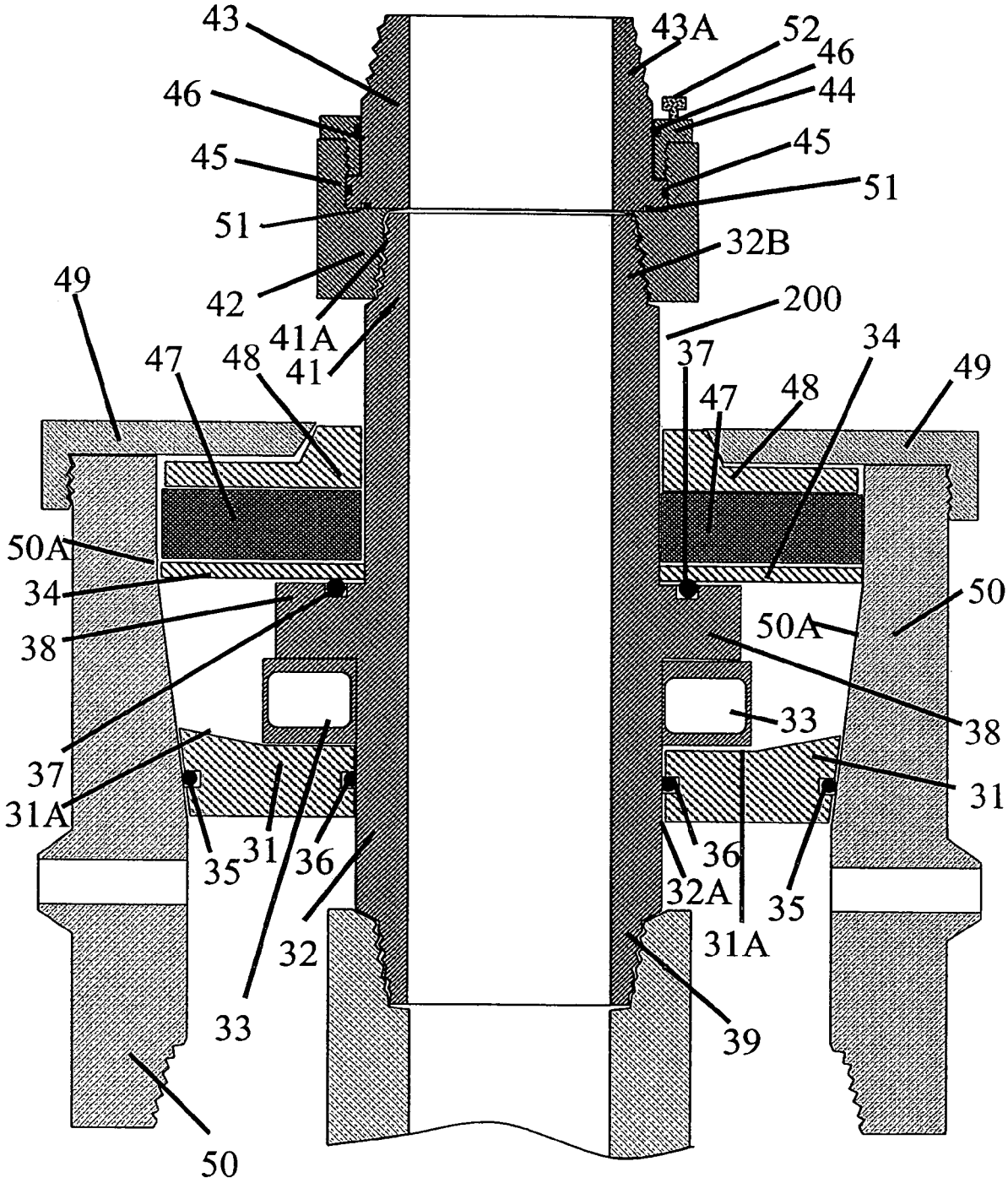
FIG. 5 illustrates a front view of an alternate embodiment of the present invention within a conventional wellhead.

FIG. 5 illustrates an alternate embodiment of a tubing saver rotator 200. The rotator assembly 200 includes a tubing mandrel 32 having an extending mandrel ledge 38. The mandrel ledge 38 may be rotatably supported on a top surface 31A of a bottom plate 31 or may be supported on a bearing 33, which bearing 33 rests on the top surface 31A of the bottom plate 31. The mandrel ledge 38 and the bottom plate 31 therefore capture the bearing 33 therebetween. The mandrel ledge 38 of the tubing mandrel 32 therefore engages and rotatably rides against the bearing 33. As shown in FIG. 5, the bottom plate 31 disposed between an interior edge 50A of a casing head 50 and an exterior edge 32A of the tubing mandrel 32. The bottom plate 31 therefore supports the bearing 33. A mandrel plate 34 rests on top of the mandrel ledge 38 and is disposed between the interior edge 50A of the casing head 50 and the exterior edge 32A of the tubing mandrel 32. A lower interior bowl seal 36, exterior plate seal 35, and a mandrel plate seal 37 prevents fluid from contaminating said bearing 33.

The lower end of the tubing mandrel 32 is attached to the tubing string (not shown) with a lower connection 39, and the opposite end of the tubing mandrel 32 is attached to a swivel 43 with an upper connection 41. The lower and upper connection means 39, 41 are known in the art. The swivel 43 is attached to an upper end 32B of the tubing mandrel 32, which allows a lower part 42 of the swivel 43 to rotate with the tubing mandrel 32. An upper part 43A of the swivel 43 may be attached to a stationary pump tee (not shown). A swivel cap 44 connects the lower part 42 of the swivel 43 to the upper part 43A of the swivel 43, and seals 45, 46, and 51 are provided in the swivel 43 to prevent leakage or entry of fluids from the tubing mandrel 32 or environment. A union (not shown) may be used in lieu of the swivel 43 as well as substitution of other types of mechanisms to allow rotation or, the tubing mandrel 32 may be attached directly to the pump tee with the pump tee designed to allow some movement or rotation.

A rubber or packing element 47 is disposed on top of the mandrel plate 34. A top plate 48 is then disposed on the rubber or packing element 47, the top plate 48 is compressed down to squeeze the rubber element 47 between the top plate 48 and the mandrel plate 34 by a casing head dognut 49. The dognut 49 may be removed to grease the bearing 33 area if desired or to replace the top plate 48, rubber element 47, mandrel plate 34, or mandrel plate seal 37.

Other options exist to use existing casing heads or modify the casing head design as shown in FIG. 5 to accept the bottom plate 31 that provides the top surface 31A of the bottom plate 31 for the bearing 33 to be rotatably supported on, with seals 35 and 36 positioned around the bottom plate 31, if desired. Further, other options exist to connect the mandrel plate 34 to the bottom plate 31 such as using bolts, supports, or other connection means known in the art.

The mandrel plate 34 may include additional seals (not shown) on the internal and/or external diameter of the mandrel plate 34, if desired. It should be further understood that in shallow wells, the bearing 33 may not be necessary to turn the tubing mandrel 32 if a good surface is provided between the bottom plate 31 and the mandrel ledge 38.

The purpose of the present invention is to have the mandrel bowl 1 (FIG. 1) or bottom plate 31 (FIG. 5) for the support of the tubing mandrel rotatable on a rotatable surface with said tubing mandrel attached to the string of tubing in the well. The rotatable surface may consist of one or more bearings located between the mandrel ledge and the bowl ledge support or bottom plate. The bearing(s) would preferably be a thrust bearing or a bearing with some thrust bearing capability and could be of the cylindrical roller bearing, needle bearing, tapered roller bearing, spherical bearing, ball bearing, and/or other bearing means. Thrust washers or a good surface between the mandrel ledge and the bottom plate could be used if the thrust weight is low enough to allow rotation of the tubing mandrel. Thus, the rotatable surface may consist of bearings, thrust washers, a good surface between the bottom plate, and other rotatable surface means.

Referring again to FIG. 1, in the preferred embodiment seals are positioned between the tubing mandrel 2 and the mandrel bowl 1, between the bowl plate 4 and the mandrel bowl 1, and between the bowl plate 4 and the mandrel ledge 10. Additional or alternate seals to prevent installation contamination or contamination from outside fluids if the rubber element 18 leaks, or contamination from inside fluids into the bearing 3 area or external of the casing head 17, may be placed between the tubing mandrel 2 and an interior 4A of the bowl plate 4, between the mandrel ledge 10 and the mandrel bowl 1, between the tubing mandrel 2 and the top plate 19, between the mandrel bowl 1 and an interior 17B of the casing head 17 which is shown as seal 1B, between the interior 17B of the casing head 17 and the bowl plate 4 which is shown as seal 4B, and/or between the interior 17B of the casing head 17 and the top plate 19. From the above description it should be understood the present invention may allow the use of no seals or the use of any combination of seals between any combination of the tubing mandrel 2, bowl plate 4, top plate 19, rubber element 18, dognut 20, mandrel bowl 1, support ledges, and the casing head interior 17B. Likewise, referring to the embodiment of FIG. 5, it should be understood the present invention may allow the use of no seals or the use of any combination of seals between any combination of the tubing mandrel 32, bowl plate 34, top plate 48, rubber element 47, dognut 49, bottom plate 31, support ledges, and the casing head interior.

Figure 3:
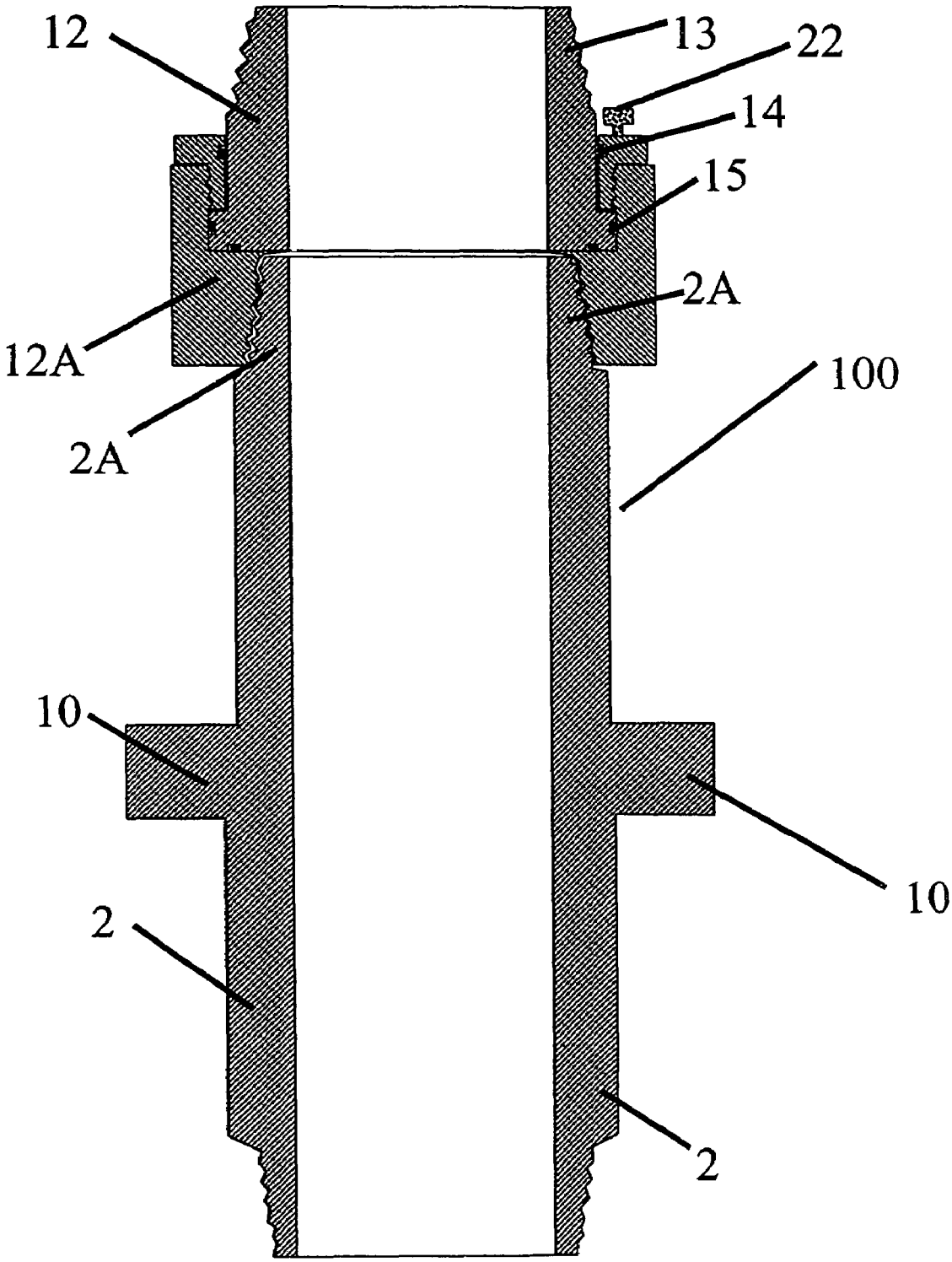
Figure 4:
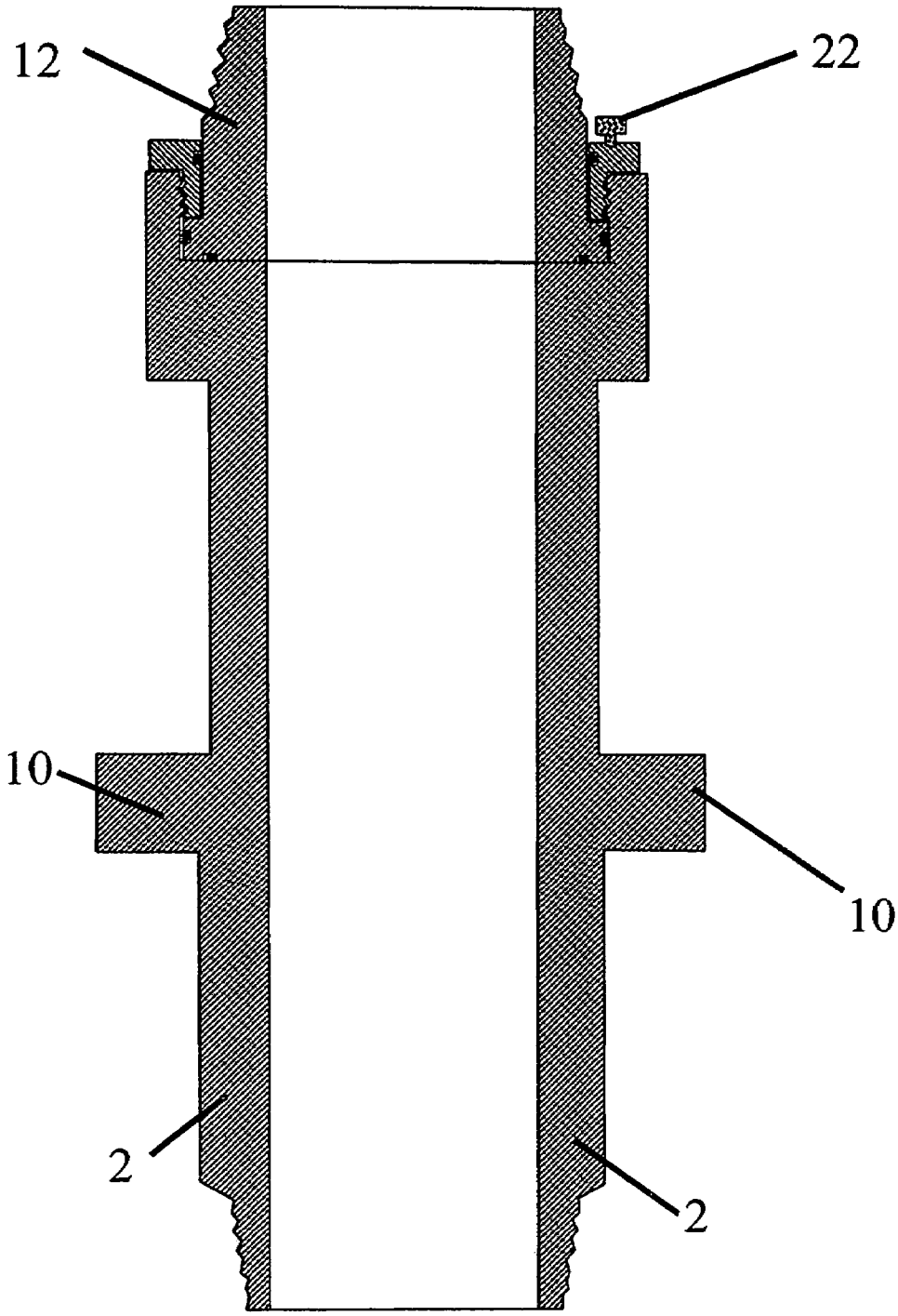

Further purpose of this invention is to allow one to attach a pump tee, swivel or union to the top of the tubing mandrel. Referring to FIG. 3, the swivel 12 may be attached to the upper end 2A of the tubing mandrel 2 or, as shown in FIG. 4, to allow for an integral part of the swivel 12 to be built as part of the tubing mandrel 2 (to reduce costs and also to reduce the clearance between the wellhead and pump tee). The swivel or union or the tubing mandrel may have edges placed on them to allow easier gripping of the tubing mandrel by a pipe wrench or a handle or automatic rotation device. In addition, one may place attachments to the rotator or swivel assembly to allow gearing or other means to rotate the tubing mandrel. These geared or other rotation means would be above the wellhead dognut and could still allow one to change the conventional sealing rubber 18 in FIG. 1 or seals associated with the tubing rotator assembly 100. The upper end of the tubing mandrel 2 has a threaded connection 11 providing attachment to the bottom of the swivel 12, a rotating piece of the swivel, a pump tee, a union or other rotation means. This threaded connection 11 can have tapered threads (pipe threads) as shown or flat threads (bolt threads), combination of flat and tapered threads, or other threaded connection means. This threaded connection 11 may allow for a sealed connection without the use of O-rings or other sealing means. One could add additional seals to the upper end of the tubing mandrel to add additional sealing protection with the threaded connection.

Figure 6:
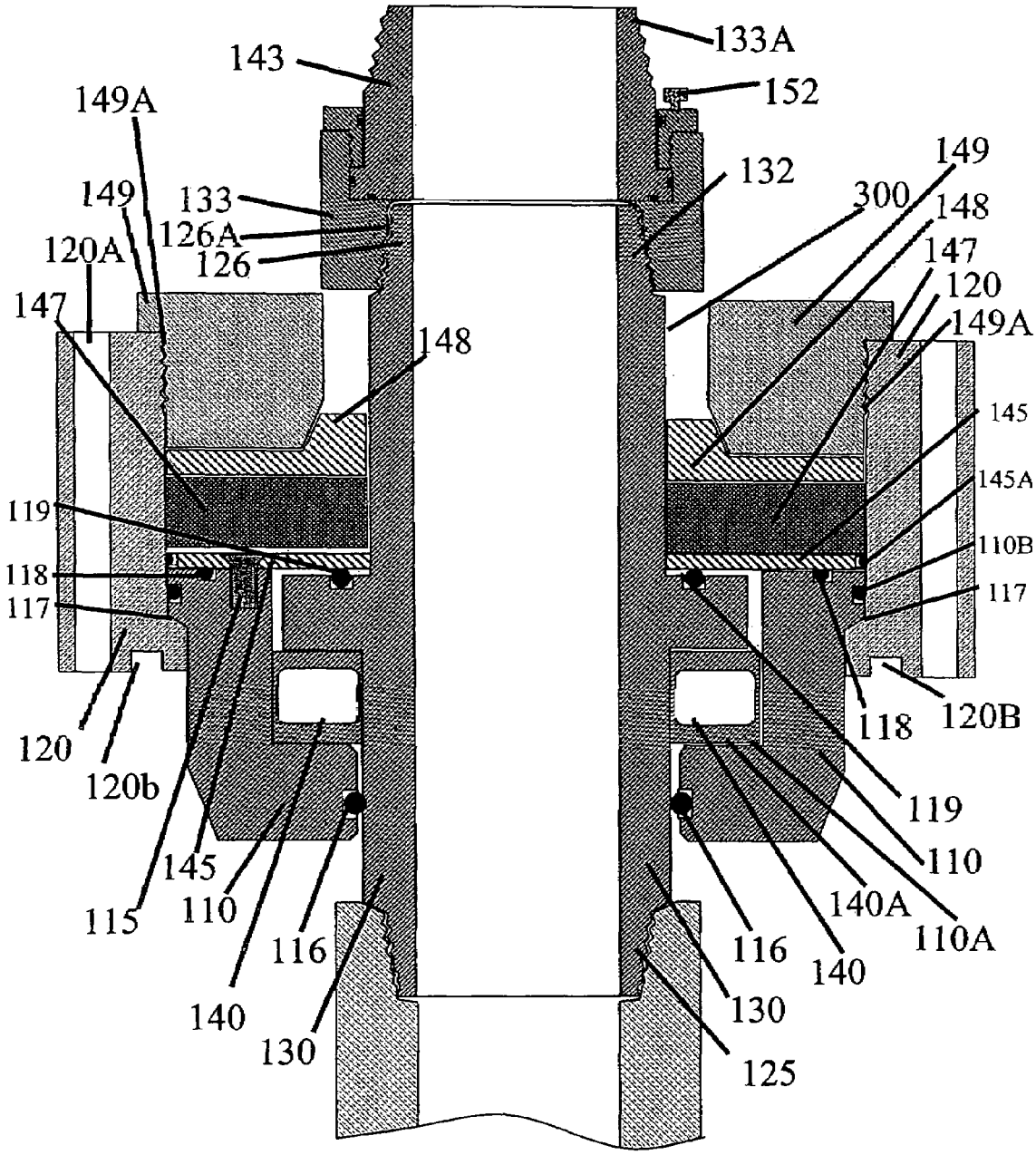
FIG. 6 illustrates a front view of a second alternate embodiment of the present invention within a conventional wellhead.

Referring now to FIG. 6, illustrating a second alternate embodiment of the present invention, a tubing saver rotator assembly 300 includes a mandrel bowl 110 having a ledge support 110A, the mandrel bowl 110 positioned on a lip 117 of a flanged connection 120. The flange connection 120 allows for connection to the wellhead with bolts (not shown) placed through bolt holes 120A and sealing provided by a conventional ring seal (not shown) seated in a ring grove 120B. An alternate arrangement is to integrally combine the mandrel bowl 110 and the flange connection 120.

A tubing mandrel 130 is stabbed into the mandrel bowl 110 and rests on the surface of the ledge support 110A of the mandrel bowl 110 or, as shown in FIG. 6, may be supported on a bearing 140, which bearing 140 rests on the ledge support 110A of the mandrel bowl 110. A bowl plate 145 is attached to the mandrel bowl 110 with bowl plate screws 115 selectively located around the bowl plate 145. Fluids are prevented from entering the bearing 140 area through a lower interior bowl seal 116, a bowl plate seal 118, and a mandrel plate seal 119. The lower end of the tubing mandrel 130 is attached to a tubing string (not shown) with a lower connection 125, and the opposite end of the tubing mandrel 130 is attached to a swivel 143 with an upper connection 126. The swivel 143 is attached to an upper end 132 of the tubing mandrel 130, and allows a lower part 133 of the swivel 143 to rotate with the tubing mandrel 130. An upper part 133A of the swivel 143 may be attached to a stationary pump tee (not shown). A union may be used in lieu of the swivel 143 as well as substitution of other types of mechanisms known in the art to allow rotation. Further, as known in the art, the tubing mandrel 130 may be attached directly to the pump tee.

A rubber or packing element 147 is disposed on top of the bowl plate 145. A top plate 148 is then disposed on top of the rubber or packing element 147, the top plate 148 is compressed down to squeeze the rubber element 147 between the top plate 148 and the bowl plate 145 by a casing head dognut 149. The casing head dognut 149 may be removed to grease the bearing 140 area if desired or to replace the top plate 148, rubber element 147, bowl plate 145, bowl plate screws 115, bowl plate seal 118, or mandrel plate seal 119. This arrangement allows most seals to be easily replaced by one person without removing the pump tee (not shown), swivel 143, tubing mandrel 130 or mandrel bowl 110 which would normally require a rig in prior art designs. In the preferred embodiment, thread means 149A attaches the dognut 149 to the flange connection 120 as shown in FIG. 6, however other similar attaching means known in the art including flange means may be used. The seals 116, 118, and 119 reduce the chance that the rubber element 147 will leak and therefore provides extra sealing protection for emissions or entry of outside fluids into the wellhead.

Other enhancements or modifications to the flanged tubing saver rotator assembly 300 includes the addition of seals between any combination of the dognut 149, the flanged connection 120, the top plate 148, the tubing mandrel 130, the mandrel bowl 110, or the bowl plate 145. In addition, the flanged connection 120 and mandrel bowl 110 may be manufactured as one piece. In addition, the user may rely on the seals 116, 118, and 119 disposed around the mandrel bowl 110, in place of the dognut 149, top plate 148, and rubber element 147. One further example of modification to the tubing saver rotator assembly 300 as described above, is to have the flange connection 120 and the mandrel bowl 110 manufactured as one piece, and using seals 116, 118, and 119 to prevent emissions or fluid entry into the wellhead, with seals 118 and 119 being replaceable without requiring use of a rig.

Figure 7:
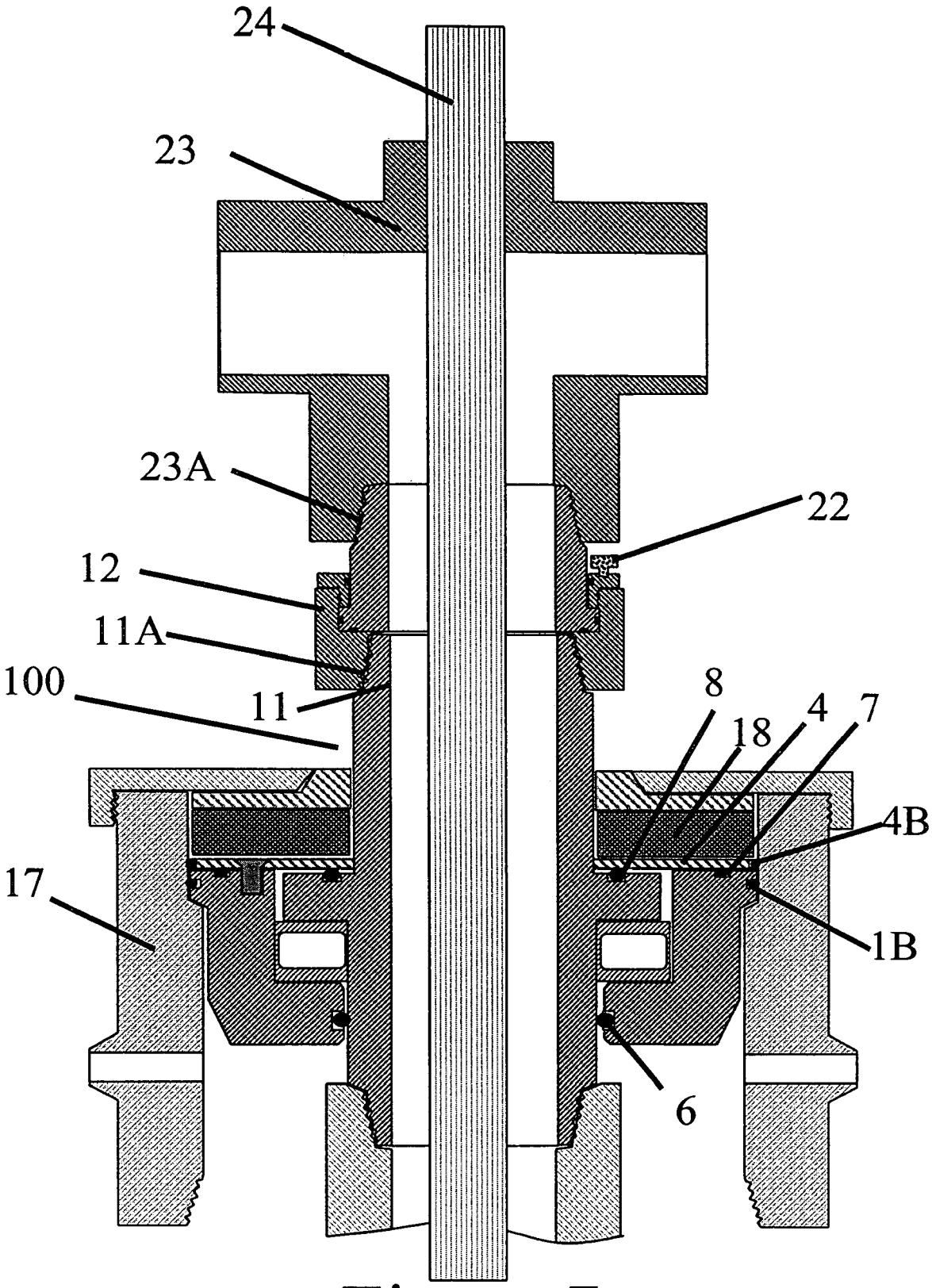
FIG. 7 illustrates the first embodiment sitting in a common wellhead with a pump tee.

FIG. 7 shows the operational mode of the preferred embodiment 100 sitting in a common wellhead 17 with a pumping tee 23 attached. The preferred embodiment 100 is attached to a swivel 12 at a threaded connection 11A. The combination of the threaded connection 11A and bowl design allow for service of the seals and rubber packing 18 without pulling the tubing string. Failure of the seals 8 or 6 will not result in loss of well function as in the prior art due to threaded connection 11A. Seal 8 or 6 failure only leads to some contamination of the bearing 1A surface. The upper end of the swivel 12 is attached to a pumping tee 23 with a connection at 23A such as a threaded connection. The pumping tee 23 allows a rod 24 to pass through it and the rod 24 is connected to a rod string that is then connected to a downhole pump (not shown). The reciprocating or rotation of this pump and rod string causes wear of the rod string against the inside of the tubing, which results in tubing failures that can be significantly reduced with the tubing saver rotator.

Figure 8:
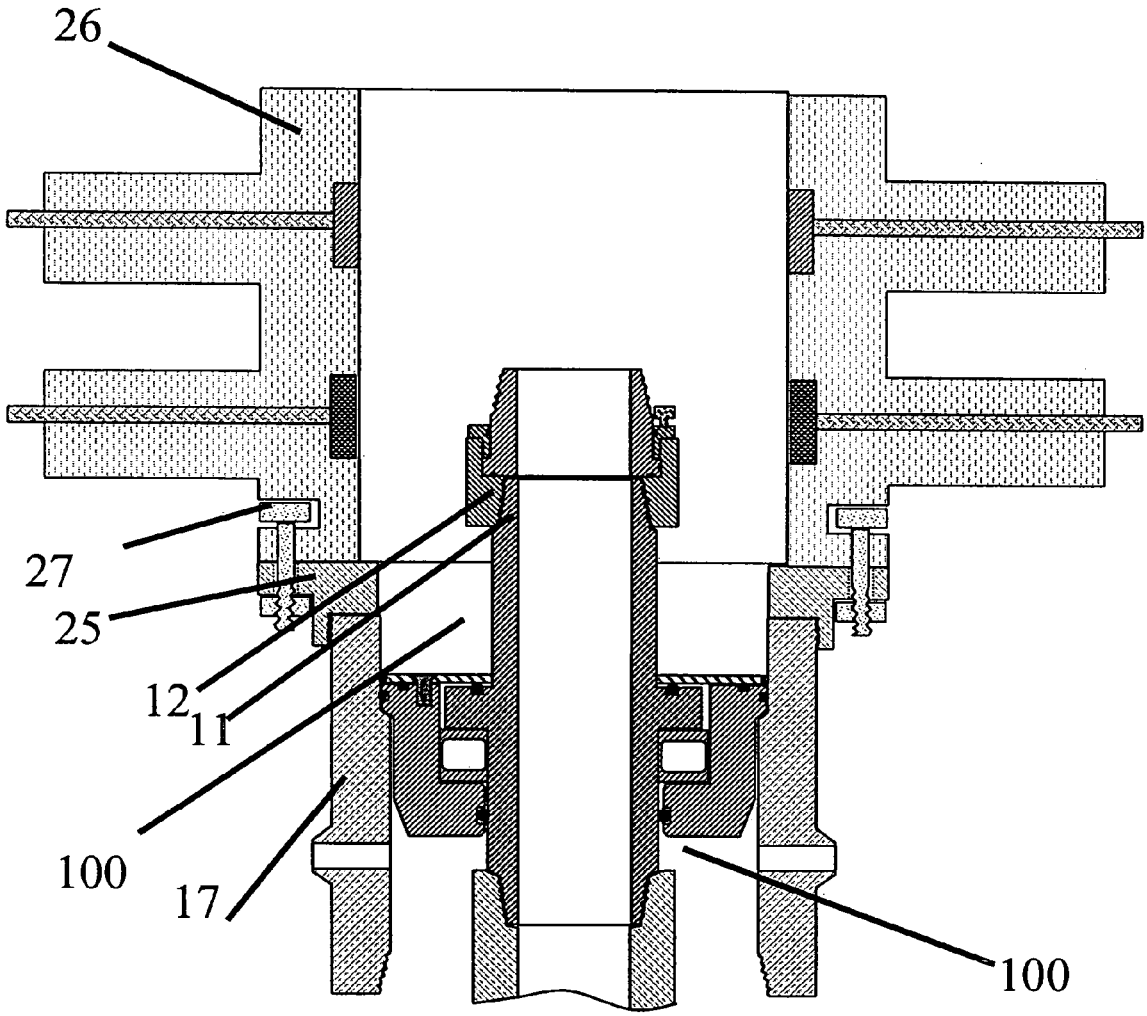
FIG. 8 illustrates the first embodiment sitting in a wellhead with blowout preventor.

FIG. 8 shows the preferred embodiment 100 sitting in a common wellhead 17 with a blowout preventer 26. The preferred embodiment 100 is attached to a swivel 12. In this figure, the wellhead cap and pump tee (not shown) have been removed from the well to allow a rig to work on the well. A companion flange 25 is screwed to the wellhead 17. This flange allows one to attach a blowout preventer 26 (BOP) to the companion flange 25 with bolts 27. The BOP preventer 26 is used to control a well that has pressure in the wellhead 17 and may be equipped with one or more types of rams: (a) shear rams to shear the equipment or pipe and provide a blanked off section, (b) pipe rams that seal against the pipe, or (c) annular rams to seal against different equipment shapes. Normally, the BOP 26 is installed with the well dead (no wellhead pressure) by removing the wellhead cap 20 and top plate 19 and rubber 18 (not shown) and installing the companion flange 25 and then the BOP 26. Notice that the preferred embodiment 100 is designed to remove the entire tubing rotation assembly through the BOP stack 26.

Figure 9:
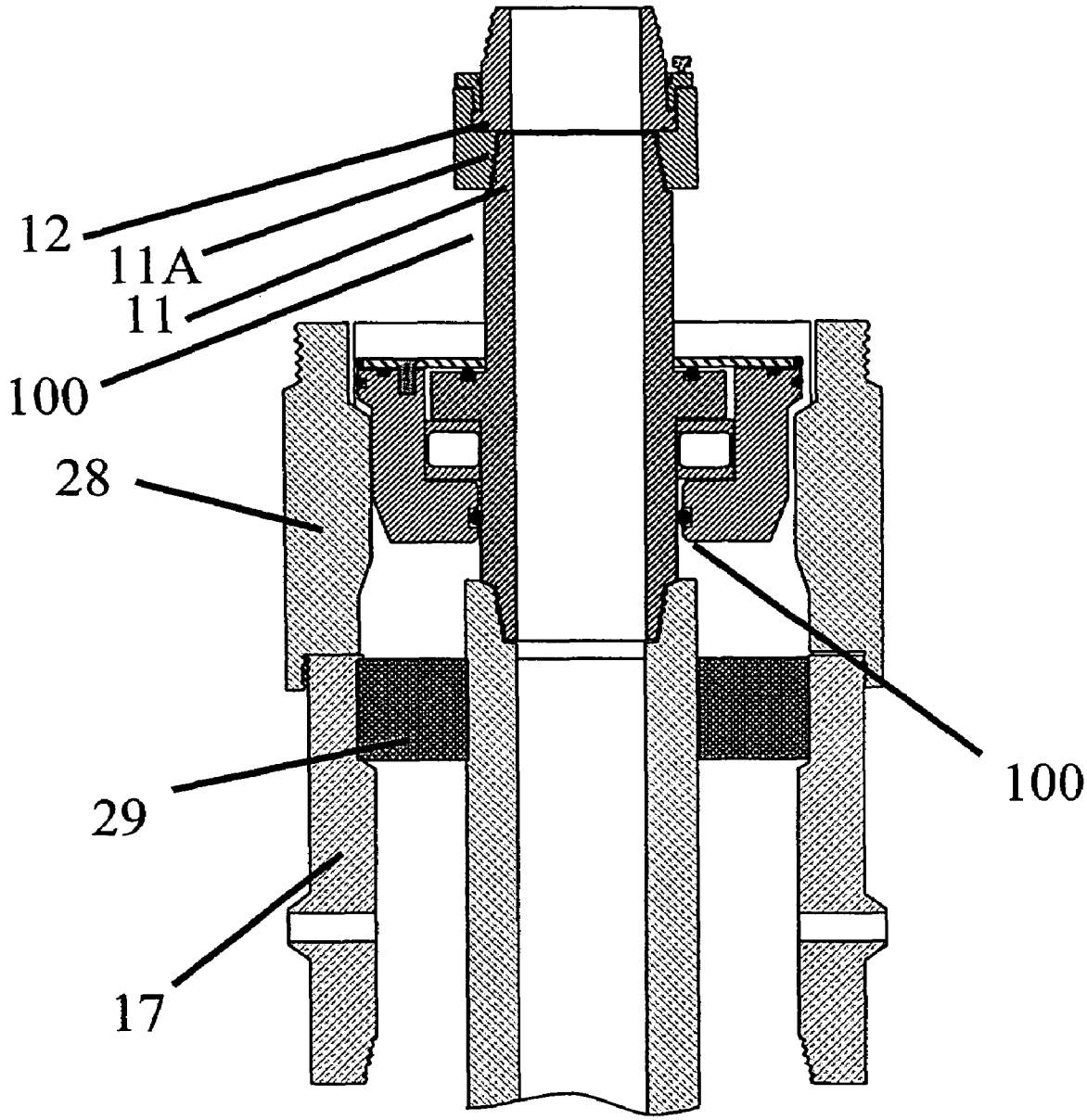
FIG. 9 illustrates the first embodiment in a wellhead with stripping head.

FIG. 9 shows the preferred embodiment 100 sitting in a common wellhead 17 with a stripping head 28. The preferred embodiment 100 is attached to a swivel 12. In this figure, the wellhead cap and pump tee have been removed from the well to allow a rig to work on the well. A stripping head 28 is screwed to the wellhead 17. This allows one to attach a stripping rubber 29 that is used to control a well with pressure in the wellhead. Normally, the stripping head 28 is installed with the well dead (no wellhead pressure) by removing the wellhead cap and top plate and rubber and tubing rotator and then screwing on the stripping head 28. Some operators will let the stripping head 28 stay attached to the wellhead 17 for future operations. This allows the operator to run the tubing string attached to the tubing rotator 100 (with or without the swivel 12) into the stripping head 28. Thus, installation of the tubing rotator equipment (even with a swivel) can be done with the well having pressure in the wellhead (pressure contained by the stripping rubber). The practice of working on a well with pressure is not commonly done. However, equipment, like a stripping head 28 or BOP 26, is utilized in case the well suddenly has pressure, which allows the operator to safely continue the operation or contain the wellhead pressure.

Figure 10:
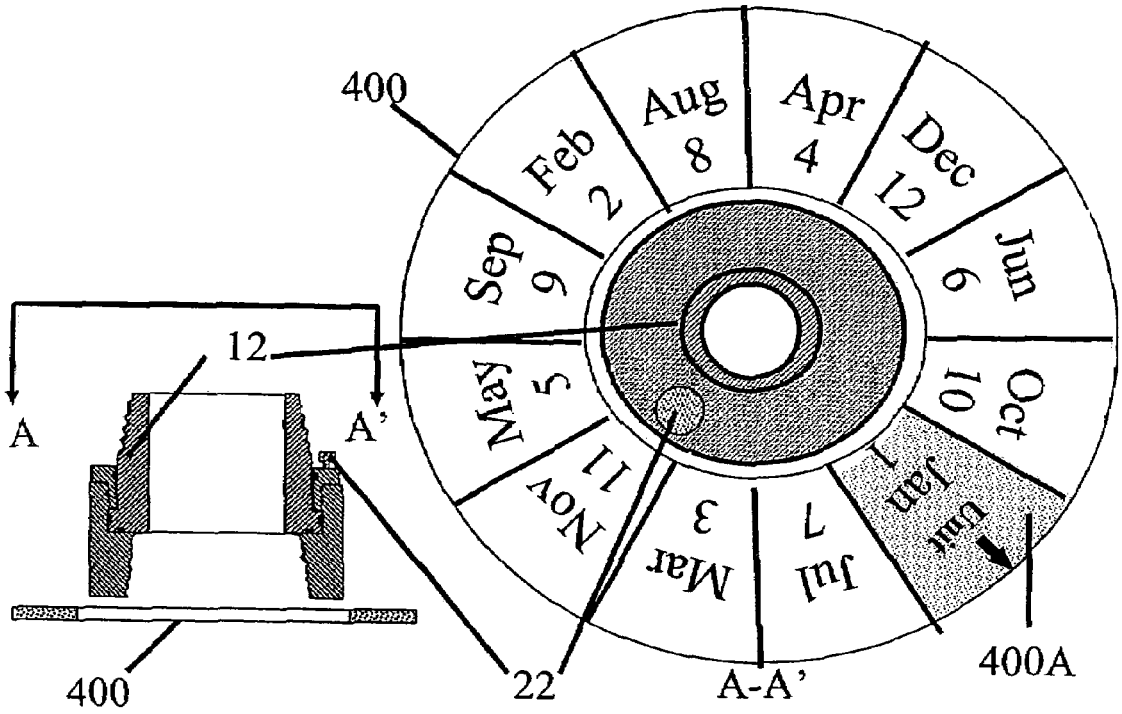
FIG. 10 illustrates recording detail useful with the first, alternate or second alternate embodiment.

FIG. 10 shows a rotation card 400 wrapped around a swivel 12 that could be used for periodic tubing rotation. The swivel 12 has a pointer 22. A top view is given that depicts the pointer 22 in relation to the rotation card 400. An operator can rotate the tubing rotator (not shown) which in turn rotates the swivel 12. Since the swivel contains a marking or pointer 12, the operator can tell where the mark was before rotating and after rotating the tubing rotator. The rotation card 400 depicts 12 months of the year in which an operator can turn the well once a month with the pointer pointing to the appropriate month. An alignment area 400A is used to align the rotation card 400 towards the existing pumping unit at the well (not shown). This alignment helps the rotation card 400 to stay in a certain direction relative to the wellhead that does not rotate. Thus, the pointer 22 will be consistent from rotation period to rotation period (and well to well) also if desired. The pointer 22 could be markings or a pin or other pointing denotation means attached to the swivel 12 or other swivel means. The pointing denotation means may also be present on the tubing rotator (not shown) or in combination with the swivel means. With the rotation card 400, an operator may turn the tubing 12 times in a year, thus spreading the wear around the tubing. With manual rotation, the tubing is not rotating throughout the year, but is stationary except for the few seconds that the operator turns the rotator every month. This "periodic rotation" is vital in reducing the tubing failures due to corrosion versus a continuous rotation methodology normally found in the art with geared tubing rotators. Periodic rotation may also be achieved with automatic rotation designs that do not rotate continuously.

A majority of wells have corrosion problems that utilize chemical corrosion inhibitors to provide a thin film on the tubing and rods to protect the tubing from corrosion. Unfortunately, the wear of the rods (in non-rotated wells and periodically rotated wells) will often wipe away this corrosion film (or reduces its effectiveness) leaving about 20 percent of the circumference having the corrosion inhibitor removed and allowing corrosion of the tubing to occur. Continuous tubing rotation (with geared tubing rotators) spreads the wear around the tubing by usually obtaining around one (1) rotation a day. Therefore, continuous rotation is continuously wiping away the corrosion inhibitor pumped into the well for protection causing one hundred percent (100%) of the circumference to have corrosion in the wear areas. With "periodic rotation", the tubing does not rotate for most of the year. It is rotated for roughly a quarter turn for a few seconds every period (about once per month is common, see Rotation Card 400). Thus, the chemical is not worn off by the rod wear over eighty percent (80%) of the circumference due to its stationary periods, but is worn off on around twenty percent (20%) of the circumference allowing some corrosion to occur. When the tubing is rotated, the operator can then apply another chemical inhibitor coating (normally about once per month also) to protect the tubing, which will coat the previous wear area that had no chemical protection in the prior rotation period. A new twenty percent (20%) of the tubing is having wear wipe of the corrosion inhibitor after this rotation. This "periodic rotation" followed by long periods of no rotation extends the tubing life by causing the corrosion to occur over more of the circumference. Continuous tubing rotation will not benefit these "corrosion failures due to wear wiping off the inhibitors" since the inhibitor is rubbed off in about one day.

Figure 11:
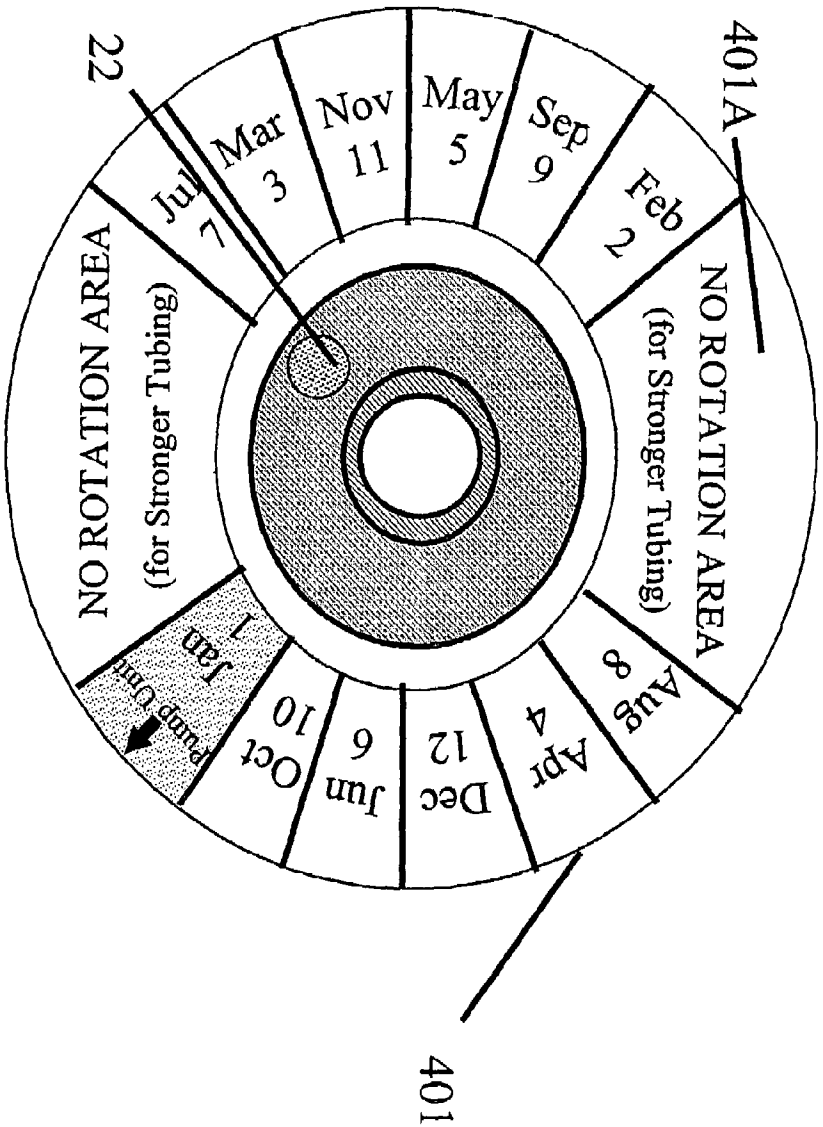
FIG. 11 illustrates alternate detail.

FIG. 11 shows a rotation card 401 wrapped around a swivel 12 that is similar to the technique and design described in FIG. 10. However, the rotation card is marked with a No Rotation Area 401A in which a pointer 22 is not supposed to be pointed towards. This results in "disproportionate rotation." Since the operator does not rotate the tubing into the No Rotation Area 401A, part of the tubing (about twenty-five percent (25%) of the circumference with rotation card 401) will not be worn down due to the rods wearing on the tubing. This "disproportionate rotation" is in contrast to the use of the rotation card 400 or continuous rotation, which both provide for essentially even wear around the circumference of the tubing ("proportional rotation"). Thus "disproportionate rotation" will allow wear to spread around the tubing except for the areas marked as No Rotation Area 401A, which shortens the life of the tubing. Theoretically, "proportional rotation" will cause the tubing to last approximately five (5) times as long as a non-rotated well, while "disproportionate rotation" (using rotation card 401) will cause the tubing to last four (4) times as long as a non-rotated well. The advantage of "disproportionate rotation" is to allow certain parts of the tubing to not be worn leaving a greater wall thickness over part of the circumference of the tubing. In the deeper wells, the weight of the tubing or rig pull required to release tubing anchors may cause a very thin walled tubing to fail due to tension and pull apart in the wellbore. This parting of the tubing will lead to a costly workover operation on the well to fish the parted tubing from the well. "Disproportionate rotation" is designed to allow the operator to have sufficient wall thickness to pull the tubing out of the well without parting (which may occur in proportional or continuous rotation). This "disproportionate rotation" allows the tubing rotator to be utilized in more wells and in deeper applications with less chance of parting the tubing after a tubing hole occurs due to wear. This "disproportionate rotation" can be designed to vary the percentage of the tubing that is not worn, which results in different designs or methodologies in rotating the tubing. This allows the operator to benefit tubing strength while sacrificing tubing life between failures while still obtaining greater tubing life than achievable on a non-rotated well. The operator may also gain in tubing life by utilizing "disproportionate rotation" in conjunction with "periodic rotation" that leaves the tubing stationary for most of the year with occasional turns of the tubing for a few seconds per period without rotating the pointer into the No Rotation Area 401A. This allows the operator to gain tubing strength while also benefiting "corrosion failures due to wear wiping off the corrosion inhibitor."

The use of pins, pointers, markings, and other pointing means can also be used with or without rotation cards. In addition, markings on the wellhead, pump tee, geared equipment, or other equipment can be used in lieu of or in conjunction with rotation cards and other markings and pointing mechanisms. Thus, several options are possible to utilize these pointer denotation means as a guide to help the operator achieve disproportionate rotation, periodic rotation, or other rotation schemes.

Although the description above contains many specificities, these should not be construed as limiting the scope of the invention but as merely providing illustrations of a presently preferred embodiment of this invention.

Thus the scope of the invention should be determined by the appended claims in the formal application and their legal equivalents, rather than by the examples given.

We claim:

1. A rotator assembly in a fixed casing head, wellhead or tubing head, hereinafter collectively referred to as a head, for rotatably suspending a tubing string for linear pumping motion in an oil well, said rotator assembly comprising:

a mandrel bowl in communication with the head, said mandrel bowl having a ledge support, said ledge support having a rotation surface, a bearing, a tubing mandrel rotatably mounted to the mandrel bowl, said tubing mandrel having an upper end, a lower end, and a mandrel ledge, wherein the bearing is disposed between said ledge support and the mandrel ledge of the tubing mandrel, wherein the mandrel ledge engages and rotatably rides on the bearing, a bowl plate positioned between the head and the tubing mandrel, and wherein the lower end of the tubing mandrel is attached to the tubing string, and wherein the upper end of the tubing mandrel is attachable to a rotation means with a threaded connection and wherein the removal of said threaded member allows said mandrel and bowl to be lifted out of said head for servicing and, at least one seal disposed between the mandrel bowl and the bowl plate, and a pointer to indicate and record positions of the normally non-rotating mandrel relative to the head throughout a year and to indicate a position to which the mandrel should be rotated to using said rotation means.

2. A rotator assembly in a fixed casino head, wellhead or tubing head, hereinafter collectively referred to as a head, for rotatably suspending a tubing string for linear pumping motion in an oil well, said rotator assembly comprising:

a mandrel bowl in communication with the head, said mandrel bowl having a ledge support, said ledge support having a rotation surface, a bearing, a tubing mandrel rotatably mounted to the mandrel bowl, said tubing mandrel having an upper end, a lower end, and a mandrel ledge, wherein the bearing is disposed between said ledge support and the mandrel ledge of the tubing mandrel, wherein the mandrel ledge engages and rotatably rides on the bearing, a bowl plate positioned between the head and the tubing mandrel, and wherein the lower end of the tubing mandrel is attached to the tubing string, and wherein the upper end of the tubing mandrel is attachable to a rotation means with a threaded connection and wherein the removal of said threaded member allows said mandrel and bowl to be lifted out of said head for servicing, wherein the head includes monthly alignment positions such that wear of said linear string on said mandrel can occur at different areas each month.

3. A rotator assembly in a fixed casing head, wellhead or tubing head, hereinafter collectively referred to as a head, for rotatably suspending a tubing string for linear pumping motion in an oil well, said rotator assembly comprising:

a mandrel bowl in communication with the head, said mandrel bowl having a ledge support, said ledge support having a rotation surface, a bearing, a tubing mandrel rotatably mounted to the mandrel bowl, said tubing mandrel having an upper end, a lower end, and a mandrel ledge, wherein the bearing is disposed between said ledge support and the mandrel ledge of the tubing mandrel, wherein the mandrel ledge engages and rotatably rides on the bearing, a bowl plate positioned between the head and the tubing mandrel, and wherein the lower end of the tubing mandrel is attached to the tubing string, and wherein the upper end of the tubing mandrel is attachable to a rotation means with a threaded connection and wherein the removal of said threaded member allows said mandrel and bowl to be lifted out of said head for servicing and, at least one seal disposed between the mandrel bowl and the bowl plate, and a pointer to indicate and record positions of the normally non-rotating mandrel relative to the head throughout a year and to indicate a position to which the mandrel should be rotated to using said rotation means, a card cooperating with said pointer, wherein said card includes positions associated with months of the year such that said tubing mandrel can be rotated to a position relative to said string and maintained in said position during a month of operation and, wherein the card includes a non-rotation area indicating a position into which the pointer is never rotated preventing wear of a portion of said mandrel.

* * * * *